US007852179B2

(12) United States Patent
Hasenour et al.

(10) Patent No.: US 7,852,179 B2
(45) Date of Patent: Dec. 14, 2010

(54) RELAY WITH AUTOMATED OVERTRAVEL ADJUSTMENT

(75) Inventors: Tim Hasenour, Clemmons, NC (US); Kurt Thomas Zarbock, Advance, NC (US); David Glen Parker, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 225 days.

(21) Appl. No.: 12/115,638

(22) Filed: May 6, 2008

(65) Prior Publication Data

US 2009/0278637 A1 Nov. 12, 2009

(51) Int. Cl.
*H01H 67/02* (2006.01)

(52) U.S. Cl. ..... 335/128; 335/78

(58) Field of Classification Search ..... 335/78, 335/128–131, 18–21, 71, 93, 121, 165, 185–192, 335/8–86, 124, 202, 258
See application file for complete search history.

(56) References Cited

U.S. PATENT DOCUMENTS 3,076,880 A * 2/1963 Ehrismann ..... 335/129
3,624,571 A * 11/1971 Magida ..... 335/197
3,748,611 A * 7/1973 Heath ..... 335/197
5,289,144 A * 2/1994 Liao ..... 335/78
5,572,176 A * 11/1996 Heinzl et al. ..... 335/129
5,905,422 A * 5/1999 Doneghue ..... 335/78

FOREIGN PATENT DOCUMENTS

EP 0 844 635 5/1998
WO WO 00/24019 4/2000

OTHER PUBLICATIONS

European Search Report, International Application No. EP 09 15 9280, International Filing Date Apr. 8, 2010.

* cited by examiner

*Primary Examiner*—Elvin G Enad
*Assistant Examiner*—Bernard Rojas

(57) ABSTRACT

An electromagnetic relay has a relay coil, an armature, a pusher and a contact system. The armature is actuated by the relay coil, and linked to the pusher to drive the pusher to operate the contact system. A set of stationary contact springs and a set of moveable contact springs have a gap separating them. The moveable contact springs connect to the pusher and to a pivot point. The stationary springs have a notch therein adjacent to the base structure portion. The pusher movement causes the stationary contact springs and the moveable contact springs to engage or disengage, and to automatically adjust the overtravel angle of the stationary contact springs relative to the moveable contact springs by bending the stationary contact spring at the notch of the stationary contact spring.

20 Claims, 3 Drawing Sheets

RELAY WITH AUTOMATED OVERTRAVEL ADJUSTMENT

BACKGROUND

The application generally relates to an electromagnetic relay. The application relates more specifically to an electromagnetic relay having a relay actuator with an automated overtravel adjustment for the electrical contacts.

A relay is an electromagnetically actuated, electrical switch. Conventional relays include stationary contacts and moving contacts corresponding with the stationary contacts. When the relay is electromagnetically actuated, the moving contacts engage or disengage with the stationary contacts, to respectively close or open an electrical circuit.

A conventional relay has a base structure, a housing, a relay coil, an armature, a pusher and a contact system. The base structure and housing are made of an electrically insulating material and support and enclose the operative electromagnetic parts of the relay. The relay coil has a coil and a magnetically permeable core connected to the tilting armature to move the armature. The coil is a cylindrical hollow member with a rectangular internal cross section corresponding to a cross section of the core, and is spring loaded to return to a specified position when the coil is de-energized. The pusher links the tilting armature and the contact system.

When manufacturing a relay, the relay stationary contact springs and moving contact springs are set to make contact concurrently when closing. Both the moving spring and stationary springs include metallic pads or tips that serve as the mutual point of contact. The spring tips absorb wear and tear caused by the actuation force, electrical arcing, repetitious movements, and other deteriorating factors. To account for this deterioration due to repeated use, an over-travel adjustment must be provided. This process involves manipulating the contact springs, which are generally made from copper, copper alloys or similar conductive materials. The contact springs must be manually bent, turned, twisted or otherwise manipulated to attempt to set a uniform overtravel position for the plurality of contact springs. Due to the mechanical properties of the metallic contact springs, it is difficult to achieve a reliable and precise overtravel setting.

There is a need for an apparatus and system for automatically achieving a uniform overtravel adjustment for contact springs in an electromagnetic relay.

Intended advantages of the disclosed systems and/or methods satisfy one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to an electromagnetic relay. The electromagnetic relay has a relay coil, an armature, a pusher and a contact system. The armature is pivotably actuated by the relay coil, and linked to a trailing end of the pusher to drive a forward edge of the pusher to operate the contact system. The contact system has at least one stationary contact spring and at least one moveable contact spring having a gap separating the stationary contact spring and the moveable contact spring. The moveable contact springs are connected at a first end to the pusher and at a second end to a first pivot point. As the armature pivots, the armature moves the pusher linearly between a forward position and a return position in response to an electromagnetic force generated by the relay coil. The stationary springs have a connection point to a base structure portion, and include a flex point in the stationary spring adjacent to the base structure portion. The movement of the pusher causes the one stationary contact springs and the moveable contact springs to engage or disengage.

Another embodiment relates to a contact system for an electromagnetic relay having an armature pivotably actuated by a relay coil linked to a trailing end of a pusher to drive a forward edge of the pusher. The contact system includes at least one stationary contact spring and at least one moveable contact spring having a gap separating the stationary contact springs and the moveable contact springs. The moveable contact springs are connected at a first end to the pusher and at a second end to a first pivot point. As the armature pivots, the armature moves the pusher linearly between a forward position and a return position in response to an electromagnetic force generated by the relay coil. The at least one stationary spring includes a connection point to a base structure portion. The stationary spring includes a flex point adjacent to the base structure portion. The movement of the pusher causes the stationary contact springs and the moveable contact springs to engage or disengage, and adjust an angle of the stationary contact spring.

A further embodiment is directed to a method of adjusting overtravel angle of a plurality of contact springs in an electromagnetic relay. The method includes positioning an overtravel adjustment fixture on one side of a plurality of stationary contacts of the relay, and a plurality of moveable contacts corresponding to the plurality of stationary contacts on a second side of the plurality of stationary contacts opposite from the overtravel adjustment fixture; aligning a plurality of pushrods of the overtravel adjustment fixture with the plurality of contact springs; moving the plurality of moveable contacts in the direction of the plurality of stationary contacts until each moveable contact of the plurality of moveable contacts makes an initial contact with a corresponding stationary contact of the plurality of stationary contacts; and setting an overtravel angle associated with each contact of the plurality of moveable contacts by pushing each stationary contact an additional distance after sensing the initial contact of all of the plurality of moveable contacts and the corresponding stationary contacts.

Certain features of the embodiments described herein are a simplified, easily replicated and precise mechanism for overtravel adjustment in an electromagnetic relay.

Another feature is an automated system that allows for more consistent and uniform overtravel adjustment of multiple relay contacts than that produced by the manual adjustment method of bending each contact spring.

Yet another feature is a moveable relay contact spring having a pre-bias angle.

Alternative exemplary embodiments relate to other features and combinations of features as may be generally recited in the claims.

BRIEF DESCRIPTION OF THE FIGURES

Wherever possible, the same reference numbers will be used throughout the drawings to refer to the same or like parts.

DETAILED DESCRIPTION OF THE EXEMPLARY EMBODIMENTS

Figure 1:
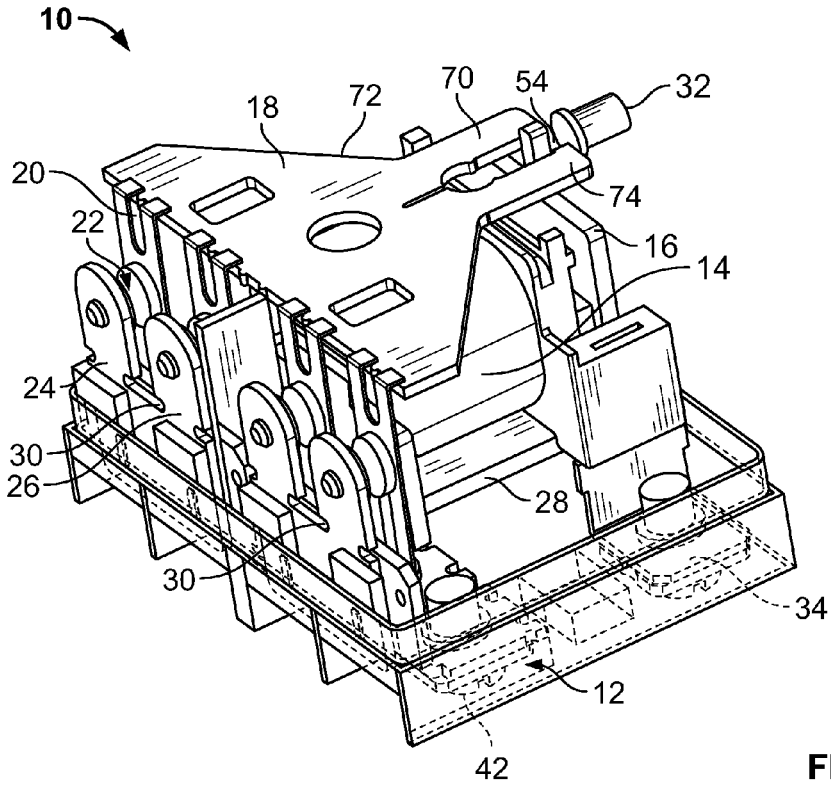
FIG. 1 is a perspective view of the relay operating mechanism.

Referring now to FIG. 1, an electromagnetic relay operating mechanism 10 includes a contact arrangement 12 and a relay coil 14 that is fixedly mounted on a base structure 28. The relay coil 14 operates on a movable hinged armature 16 to move the armature 16 between two positions, one position corresponding to the relay coil 14 energized state and one corresponding to the relay coil 14 deenergized state. The armature 16 is linked to the contact arrangement 12 by a pusher 18. The contact arrangement 12 includes a set of stationary contact springs 26 and a set of moveable contact springs 20. The moveable contact springs 20 are connected at one end to the pusher 18 and at the opposite end to a pivot point 38 (see, e.g., FIG. 2). The armature 16 moves linearly, to a forward position and return position, in response to the actuation force generated by the solenoid. When driven to the forward position, the moveable contact springs 20 engage with stationary contact springs 26 at contact tips 22, 24, respectively. The spacing of the moveable contact tips 22 from the stationary contact tips 24 is initially set during manufacturing, as will be explained below. The contact arrangement 12 also includes external connection terminals 42 that provide electrical termination points on the exterior of the relay housing 66 (See, e.g., FIG. 3). In addition, the base structure 28 has external termination points 34 that project through the relay housing 66, for interconnecting the relay coil 14 to a control circuit or other voltage source (not shown). In the exemplary embodiment of FIG. 1, the contact arrangement 12 is illustrated as a two-pole relay, i.e., two sets of stationary contact springs 26 that interface with two sets of moveable contact springs 20, to control two independent sets of external connection terminals 42. It will be appreciated by those skilled in the art that the two-pole relay configuration is merely exemplary, and that more or less poles may be controlled using the operating mechanism 10 disclosed herein, within the scope of the present invention.

Figure 2:
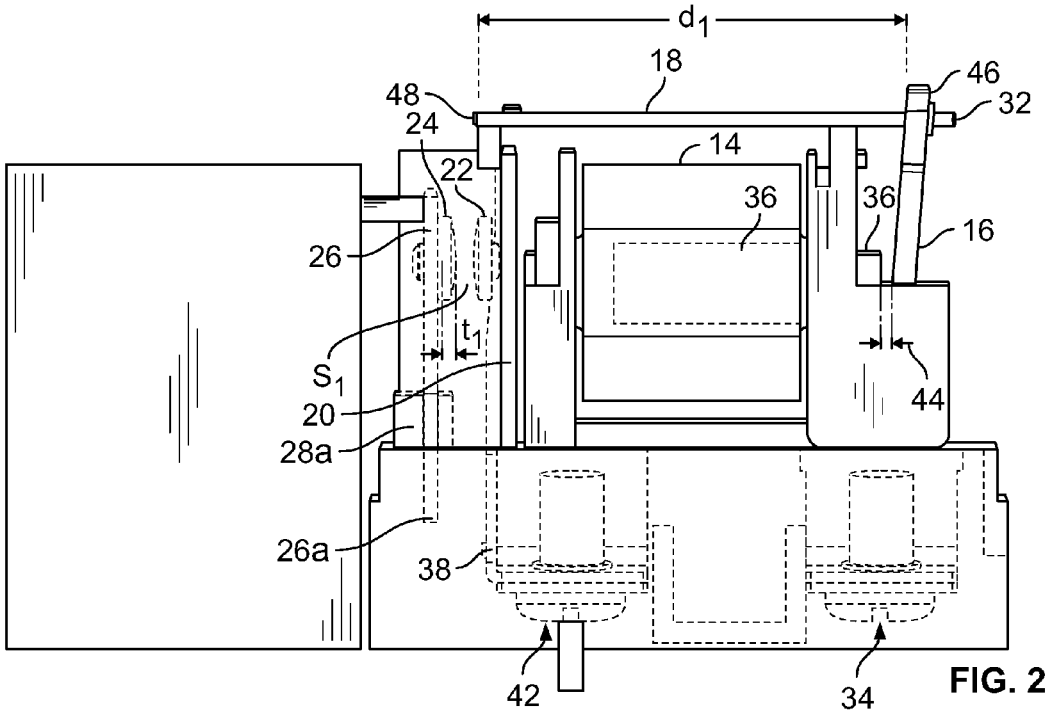
FIG. 2 is an elevational view of the relay operating mechanism.

Referring next to FIG. 2, a side view of the relay operating mechanism 10 is shown. Over-travel of the moveable contact springs 20 is required when initially setting the position of the moveable contact springs 20. Over-travel compensates for contact erosion over time. The additional travel length allows the contact tips 22, 24 to meet cycle life requirements as they wear, and the thickness T1 of the contact tips 22, 24 is diminished. In conventional relays, as the thickness t1 diminishes, the gap s1 between one or more pairs of the contact tips 22, 24 increases, until eventually the gap is too great to permit contact to occur when required. The present invention provides a means to ensure more even wear and spacing to achieve the desired cycle life. To achieve desired performance a fixed, predetermined gap spacing 44 is provided between the armature 16 and the solenoid core 36. The core is magnetized when the relay coil 14 is energized, and the armature 16 moves forward due to the magnetic force applied by the solenoid core 36. The armature is spring-biased or is otherwise urged away from the solenoid core 36 when the solenoid core 36 is de-magnetized. The pusher 18 is directly linked by linkage 46 to the armature 16, and travels forward and back an equal distance when the armature 16 moves. Due to molding and stamping tolerances inherent in the manufacturing of various parts, e.g., the terminals 42, 34 and relay coil 14, the position of the armature 16 relative to the contact arrangement 12 may vary inconsistently. The distance d1 between the armature linkage 46 and the forward edge 48 of the pusher 18 must be set during manufacturing. The adjustment of distance d1 changes the spacing s1 proportionally, so the contact tips 22, 24 are set to a desired spacing including overtravel.

Figure 3:
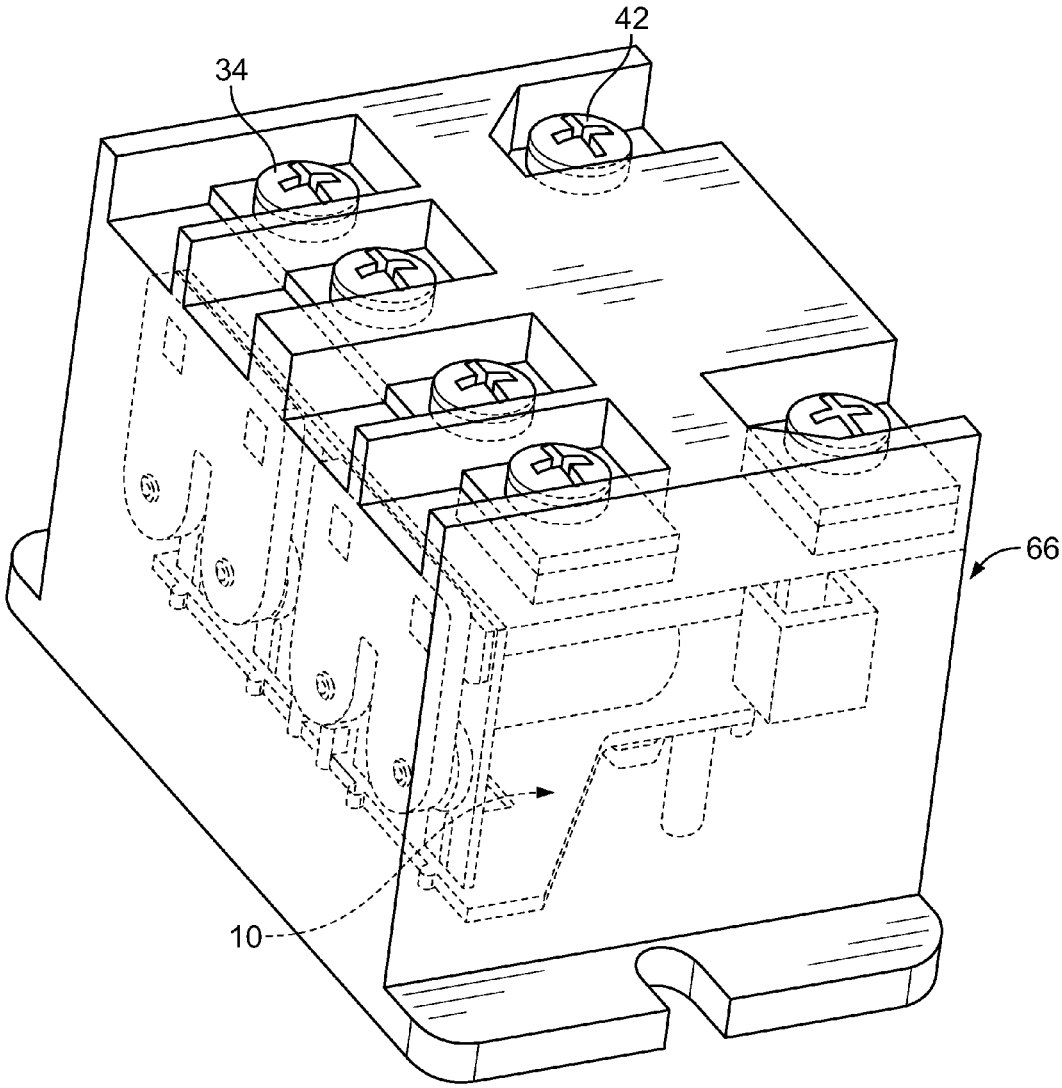
FIG. 3 is a perspective view of an assembled relay.

The stationary contact springs 26 are connected at one end 26*a* in the base structure 28*a* of the relay housing 66 (See, e.g., FIG. 3). The stationary contact springs 26 project upward from the base structure 28*a*, at an acute angle opposing the hinged or moveable contact springs 20. Due to variations in the metal that forms the springs 26, 20, variations in the thickness of tips 22, 24, and manufacturing tolerances, the stationary contact springs 26 may require adjustment of the angular position relative to the base structure 28*a*, to compensate for such variations. The angular position adjustment helps to achieve a substantially uniform, consistent mating force between the stationary contact springs 26 and the moveable contact springs 20. To facilitate the angular position adjustment of the stationary contact springs 26, a notch 30 is located in the stationary contact spring 26 adjacent the base structure 28*a*, at the point where the stationary contact spring 26 attaches to the base structure 28*a*. The moveable contact springs 20 are configured with a bias angle towards the stationary contact springs 26 when the pusher 18 is in the advanced or relay-closed position. The notches 30 provide a flex point at the base of each of stationary contact springs 26 that allows the stationary contact springs 26 to bend at angle to match the pre-bias angle of the corresponding moveable contact springs 20, thereby compensating for any deviation in the moveable contact springs 20 pre-bias angle, or differences in travel. The notches 30 are one embodiment of a means for providing a flex point or region, and other means may be used to introduce a flex region at a predetermined location on the stationary contact springs, for example, scoring, heat treating, pre-stressing, stamping, and similar techniques. An automated method of compensating for any deviation in the pre-bias angle of moveable contact springs 20 is disclosed with respect to FIGS. 4 and 5.

Figure 4:
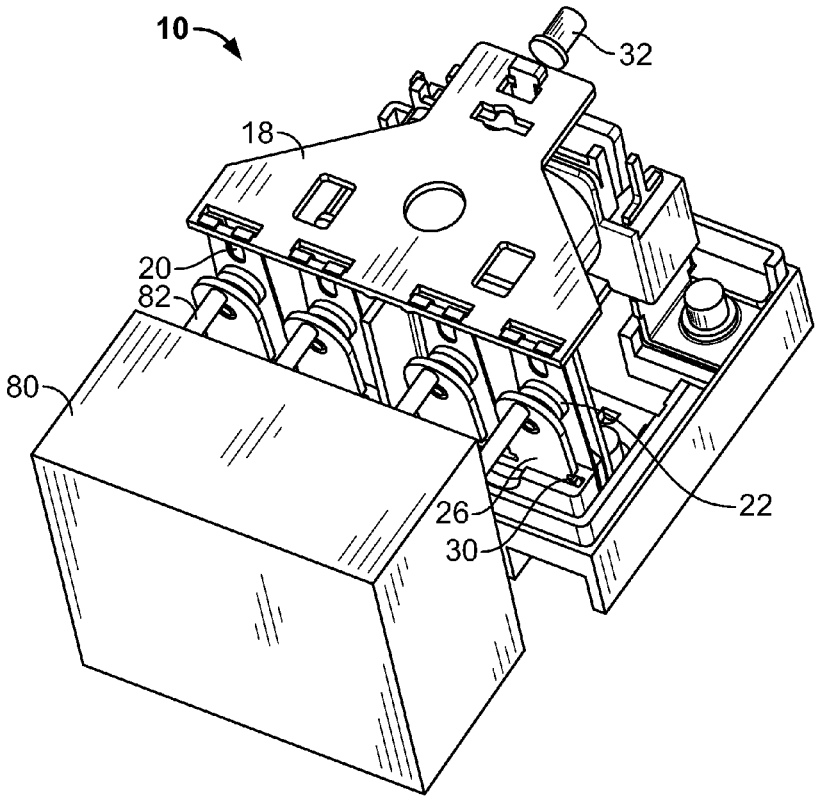
FIGS. 4 and 5 illustrate an overtravel adjustment means for the moveable contacts.
Figure 5:
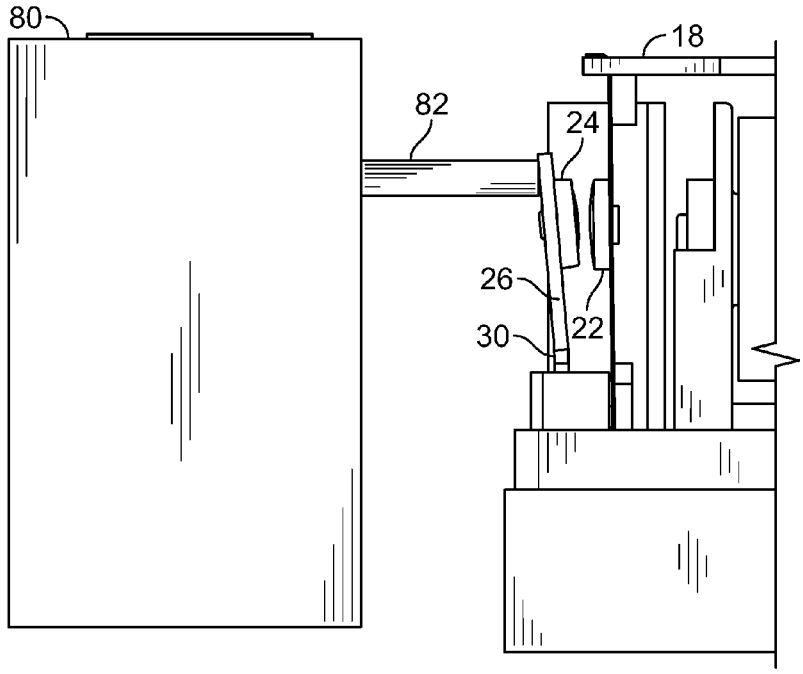

FIGS. 4 and 5 show an exemplary method of setting the overtravel of the contact springs 20, 26 using an overtravel adjustment fixture 80. The adjustment fixture 80 includes pushrods 82, which are aligned with contact springs 26. The pushrods 82 set the overtravel by urging contact springs 26 an additional distance after contacts 20, 24 make initial contact. In one embodiment, the adjustment fixture may urge the stationary contact springs 26 toward the moveable contact springs 20 by an additional 0.25 millimeters of movement. The adjustment fixture 80 applies the additional movement by urging the stationary contact springs 26 towards the moveable contact springs 20, after the initial contact is made between contact pads 22, 24. The initial contact may be determined, for example, by providing an electrical continuity sensing between the overtravel adjustment fixture 80 and external terminals 42, through the respective contact tips 22, 24 and pushrods 82.

Referring next to FIG. 3, an assembled relay 66 includes the relay operating mechanism 10 disposed within housing 66, depending from the external screw terminations 34, 42. The coil external screw terminations 42 and the contact external screw terminations 34 face upward to provide access for wiring external control or power circuits.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the relay operating mechanism 10, as shown in the various exemplary embodiments, is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted. Also two or more steps may be performed concurrently or with partial concurrence. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. An electromagnetic relay comprising:

a relay coil, an armature, a pusher and a contact system;

the armature pivotably actuated by the relay coil, and linked to a trailing end of the pusher to drive a forward edge of the pusher to operate the contact system; and at least one stationary contact spring and at least one moveable contact spring having a gap separating the stationary contact spring and the moveable contact spring, the at least one moveable contact spring connected at a first end to the pusher and at a second end to a first pivot point, wherein as the armature pivots, the armature moves the pusher linearly between a forward position and a return position in response to an electromagnetic force generated by the relay coil;

the at least one stationary spring having a connection point to a base structure portion, the stationary spring having a flex point adjacent to the base structure portion;

wherein an automatic adjustment of the angle of the stationary contact spring is made by bending the stationary contact spring at the flex point; and the movement of the pusher causing the at least one stationary contact spring and the at least one moveable contact spring to engage or disengage.

2. The relay of claim 1, further comprising a housing for enclosing the relay coil, the armature, the pusher and the contact system.

3. The relay of claim 2, wherein the housing further includes a base structure, the base structure arranged to support the relay coil, the armature, the pusher and the contact system.

4. The relay of claim 3, further comprising the armature being moveably connected by a hinge to the base structure, and the relay coil operable on the movably hinged armature to move the armature between a first position corresponding to a relay energized state and a second position corresponding a relay deenergized state.

5. The relay of claim 3, wherein the contact system further includes external a plurality of connection terminals in communication with the contact system extending through the housing.

6. The relay of claim 5, wherein the base structure further includes a plurality of external terminations projecting through the housing for interconnecting the relay coil to a control circuit.

7. The relay of claim 1, wherein the contact system includes at least two stationary contact springs interoperable and at least two moveable contact springs for controlling at least two external connection terminals.

8. The relay of claim 1, wherein a notch provided in the at least one stationary contact springs provides the flex point for setting a deflection angle of the at least one stationary contact spring at a predetermined location, the deflection angle corresponding to a bias angle of the at least one moveable contact spring cooperative with the at least one stationary contact spring.

9. The relay of claim 8, wherein a width of the flex point is narrower than a width of the at least one stationary contact spring.

10. A contact system for an electromagnetic relay having an armature pivotably actuated by a relay coil linked to a trailing end of a pusher to drive a forward edge of the pusher, the contact system comprising:

at least one stationary contact spring and at least one moveable contact spring having a gap separating the stationary contact spring and the moveable contact spring, the at least one moveable contact spring connected at a first end to the pusher and at a second end to a first pivot point, wherein as the armature pivots, the armature moves the pusher linearly between a forward position and a return position in response to an electromagnetic force generated by the relay coil;

the at least one stationary spring having a connection point to a base structure portion, the stationary spring having a flex point adjacent to the base structure portion; wherein an automatic adjustment of the angle of the stationary contact spring is made by bending the stationary contact spring at the flex point;

the movement of the pusher causing the at least one stationary contact spring and the at least one moveable contact spring to engage or disengage.

11. The contact system of claim 10, further including a plurality of connection terminals in communication with the contact system extending through a housing.

12. The contact system of claim 10, wherein the contact system includes at least two stationary contact springs interoperable with at least two corresponding moveable contact springs for controlling at least two external connection terminals.

13. The contact system of claim 10, wherein a notch is provided in the at least one stationary contact springs, the notch providing the flex point for setting a deflection angle of the at least one stationary contact spring at a predetermined location, the deflection angle corresponding to a bias angle of the at least one moveable contact spring cooperative with the at least one stationary contact spring.

14. The contact system of claim 13, wherein a width of the flex point is narrower than a width of the stationary contact spring.

15. The contact system of claim 11, further comprising a housing for enclosing the relay coil, the armature, the pusher and the contact system.

16. The relay of claim 15, wherein the housing further includes a base structure, the base structure arranged to support the relay coil, the armature, the pusher and the contact system.

17. The relay of claim 16, further comprising the armature being moveably connected by a hinge to the base structure, and the relay coil operable on the movably hinged armature to move the armature between a first position corresponding to a relay energized state and a second position corresponding a relay deenergized state.

18. A method of adjusting overtravel angle of a plurality of contact springs in an electromagnetic relay comprising:

positioning an overtravel adjustment fixture on one side of a plurality of stationary contacts of the relay, and a plurality of moveable contacts corresponding to the plurality of stationary contacts on a second side of the plurality of stationary contacts opposite from the overtravel adjustment fixture;

aligning a plurality of pushrods of the overtravel adjustment fixture with the plurality of contact springs;

moving the plurality of moveable contacts in the direction of the plurality of stationary contacts until each moveable contact of the plurality of moveable contacts makes an initial contact with a corresponding stationary contact of the plurality of stationary contacts; and setting an overtravel angle associated with each contact of the plurality of moveable contacts by pushing each stationary contact an additional distance after sensing the initial contact of all of the plurality of moveable contacts and the corresponding stationary contacts.

19. The method of claim 18, wherein the additional distance which the overtravel adjustment fixture urges the stationary contact springs is about 0.25 millimeters.

20. The method of claim 19, also including determining the initial contact by providing an electrical continuity sensor for sensing electrical current between the overtravel adjustment fixture, the stationary contact springs, the moveable contact springs, and the pushrod.

* * * * *